US010443940B2

(12) United States Patent
Motomura et al.

(10) Patent No.: US 10,443,940 B2
(45) Date of Patent: Oct. 15, 2019

(54) RAW MATERIAL SUPPLY METHOD

(71) Applicant: PAN PACIFIC COPPER CO., LTD, Tokyo (JP)

(72) Inventors: Tatsuya Motomura, Oita (JP); Eiji Tojima, Oita (JP); Tomoya Kawasaki, Oita (JP); Yutaka Yasuda, Oita (JP)

(73) Assignee: PAN PACIFIC COPPER CO., LTD., Tokyo (JP)

( * ) Notice: Subject to any disclaimer, the term of this patent is extended or adjusted under 35 U.S.C. 154(b) by 87 days.

(21) Appl. No.: 15/206,506

(22) Filed: Jul. 11, 2016

(65) Prior Publication Data

US 2016/0320126 A1 Nov. 3, 2016

Related U.S. Application Data

(62) Division of application No. 14/502,278, filed on Sep. 30, 2014, now Pat. No. 9,689,610.

(30) Foreign Application Priority Data

Oct. 1, 2013 (JP) ..... 2013-206421

(51) Int. Cl.
*F27B 3/28* (2006.01)
*F27B 3/18* (2006.01)
(Continued)

(52) U.S. Cl.
CPC ..... *F27B 3/28* (2013.01); *F27B 3/18* (2013.01); *F27D 3/0025* (2013.01); *F27D 3/16* (2013.01);
(Continued)

(58) Field of Classification Search
CPC .... F27B 3/18; F27B 3/28; F27D 19/00; F27D 2019/0075; F27D 3/0025; F27D 3/16; F27D 3/18; F27D 7/02; F27D 7/04
(Continued)

(56) References Cited

U.S. PATENT DOCUMENTS 6,238,457 B1 5/2001 Holmi
6,565,799 B1 5/2003 Kojo
(Continued)

FOREIGN PATENT DOCUMENTS

CL 39739 A 9/1997
CL 44253 A 5/1998
(Continued)

OTHER PUBLICATIONS

Japanese Decision of Refusal, dated Sep. 19, 2017, for corresponding Japanese Application No. 2013-206421, with an English machine translation.

(Continued)

*Primary Examiner* — Scott R Kastler
*Assistant Examiner* — Michael Aboagye
(74) *Attorney, Agent, or Firm* — Birch, Stewart, Kolasch & Birch, LLP

(57) ABSTRACT

A raw material supply process that supplies a raw material into a flash smelting furnace and supplies a first gas contributing to a reaction of the raw material into the flash smelting furnace, includes: a raw material passage that is provided out of a lance through which the first gas passes, the raw material passing through the raw material passage; and an adjuster that adjusts a distribution of the raw material by blowing a second gas to the raw material passing through the raw material passage.

2 Claims, 8 Drawing Sheets

(51) Int. Cl.

| | |
|---|---|
| ***F27B 7/02*** | (2006.01) |
| ***F27D 3/16*** | (2006.01) |
| ***F27D 3/18*** | (2006.01) |
| ***F27D 7/02*** | (2006.01) |
| ***F27D 7/04*** | (2006.01) |
| ***F27D 3/00*** | (2006.01) |
| ***F27D 19/00*** | (2006.01) |

(52) U.S. Cl.
CPC ..... *F27D 3/18* (2013.01); *F27D 7/02* (2013.01); *F27D 7/04* (2013.01); *F27D 19/00* (2013.01); *F27D 2003/168* (2013.01); *F27D 2019/0028* (2013.01); *F27D 2019/0075* (2013.01)

(58) Field of Classification Search
USPC ..... 266/44, 47, 221, 266, 216; 75/645, 650, 75/649
See application file for complete search history.

(56) References Cited

U.S. PATENT DOCUMENTS

| | | | | |
|---|---|---|---|---|
| 8,206,643 | B2 | 6/2012 | Sipila | |
| 8,889,061 | B2 * | 11/2014 | Sipila | F27D 3/18 266/265 |
| 9,845,992 | B2 * | 12/2017 | Kokourine | F27D 3/0033 |
| 2004/0053185 | A1 | 3/2004 | Saarinen | |
| 2012/0248664 | A1 | 10/2012 | Sipilä et al. | |

FOREIGN PATENT DOCUMENTS

| | | | | |
|---|---|---|---|---|
| CL | 51307 | A | 4/2011 | |
| EP | 1496128 | * | 1/2005 | F27B 3/18 |
| JP | 53-130214 | U | 10/1978 | |
| JP | 2-29452 | U | 2/1990 | |
| JP | 2002-241855 | A | 8/2002 | |
| JP | 2003-160822 | A | 6/2003 | |
| JP | 2004-517214 | A | 6/2004 | |
| JP | 2012-224880 | A | 11/2012 | |
| JP | 2013-513727 | A | 4/2013 | |

OTHER PUBLICATIONS

Japanese Office issued in Japanese Application No. 2013-206421 dated Jul. 4, 2017, together with an English translation.
U.S. Office Action dated Jun. 18, 2018, issued in co-pending U.S. Appl. No. 15/418,226.
U.S. Office Action dated Feb. 15, 2019, for counterpart U.S. Appl. No. 15/418,226.

* cited by examiner

RAW MATERIAL SUPPLY METHOD

CROSS-REFERENCE TO RELATED APPLICATION

This application is a Divisional of application Ser. No. 14/502,278, filed Sep. 30, 2014, now, U.S. Pat No. 9,689,610, which claims priority under 35 U.S.C. 119(a) to Japanese Patent Application No. 2013-206421, filed in Japan on Oct. 1, 2013, the entire contents of which are incorporated herein by reference.

FIELD

The present invention relates to a raw material supply apparatus. a raw material supply method and a flash smelting furnace.

BACKGROUND

A flash smelting furnace is a smelting furnace used for a smelting of non-ferrous metal such as copper or nickel and a matte-treating smelting. The flash smelting furnace has a shaft in an upper portion of a settler of a reverberating furnace type. When raw material and reaction gas are blown from the top of the shaft, oxidizing heat of the raw material is used at a maximum. The raw material is instantly oxidized and melted. In the flash smelting furnace, an apparatus to supply the raw material and the reaction gas into a furnace acts as an important role to determine performance of the flash smelting furnace. The performance of the raw material supply apparatus determines reaction effectiveness and degree of reaction progress of the raw material in the reaction shaft. Thereby, the performance has influence on a processing capacity and metal recovery of the flash smelting furnace. It is preferable that the reaction in the reaction shaft of the flash smelting furnace is speedy and all raw material reacts evenly at an identical degree of reaction progress. It is therefore preferable that the raw material is supplied to the flash smelting furnace evenly.

Japanese Patent Application Publication No. 2003-160822 (hereinafter referred to as Document 1) discloses a technology in which raw material is supplied to a flash smelting furnace from three or more directions (for example, four directions) in order to evenly supply the raw material to the flash smelting furnace. Japanese Patent Application Publication No. 2013-513727 (hereinafter referred to as Document 2) discloses a technology in which a separation wall or a collision plate is provided in a supply passage of the raw material.

SUMMARY

It is an object to provide a raw material supply apparatus and a raw material supply method that are capable of equalizing supplied raw material and a flash smelting furnace that is capable of suppressing variability in a reaction product.

According to an aspect of the present invention, there is provided a raw material supply apparatus that supplies a raw material into a flash smelting furnace and supplies a first gas contributing to a reaction of the raw material into the flash smelting furnace, including: a raw material passage that is provided out of a lance through which the first gas passes, the raw material passing through the raw material passage;

and an adjuster that adjusts a distribution of the raw material by blowing a second gas to the raw material passing through the raw material passage.

The adjuster may have a plurality of pipe lines that blow the second gas to the raw material. The raw material supply apparatus may include a measuring device that measures the distribution of the raw material; and a controller that controls an amount of the second gas blown from each of the plurality of pipe lines to the raw material based on a measurement result of the measuring device. A pipe member having the plurality of pipe lines may be exchangeable with respect to a slit formed in a separation wall forming the raw material passage. The raw material supply apparatus may include a supply portion that supplies the raw material to the raw material passage from two directions.

According to an aspect of the present invention, there is provided a flash smelting furnace including a raw material supply apparatus that supplies a raw material into the flash smelting furnace and supplies a first gas contributing to a reaction of the raw material into the flash smelting furnace, including: a raw material passage that is provided out of a lance through which the first gas passes, the raw material passing through the raw material passage; and an adjuster that adjusts a distribution of the raw material by blowing a second gas to the raw material passing through the raw material passage.

According to an aspect of the present invention, there is provided a raw material supply method that supplies a raw material into a flash smelting furnace including: blowing a gas into a raw material passage through which the raw material passes; measuring a distribution of the raw material diffused by the blowing of the gas; and performing adjusting with respect to the blowing of the gas so that the distribution of the raw material in the raw material passage is equalized, based on a measurement result obtained in the measuring of the distribution.

The gas may be blown into the raw material passage from a plurality of directions in the blowing of the gas; and at least one of an amount and an angle of the gas blown from the plurality of directions may be adjusted in the performing the adjusting.

DESCRIPTION OF EMBODIMENTS

However, there may be a case where the raw material supplied to the flash smelting furnace has a block shape and particles are not distributed. Even if the raw material is supplied from three directions as in the case of Document 1, equalization of the raw material may be insufficient. When the equalization of the raw material is insufficient, reaction between the raw material and oxygen may be insufficient. Therefore, variability may occur in a reaction product. When a separation wall or a collision plate is provided in a supply passage of raw material as in the case of Document 2, the raw material (for example, copper wire scrap) may get stopped by the separation wall or the collision plate, and flow of the raw material may be prevented. Thereby, the equalization of the raw material may be insufficient.

Figure 1:
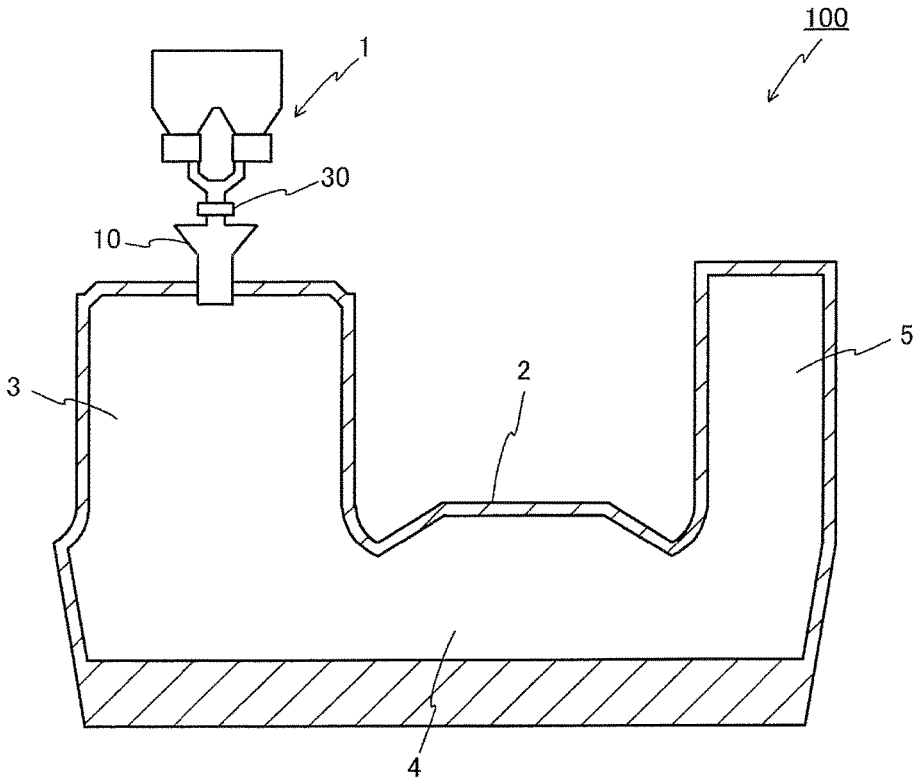
FIG. 1 illustrates a schematic structure of a flash smelting furnace for copper smelting in accordance with an embodiment.

A description will be given of a flash smelting furnace in accordance with an embodiment with reference to FIG. 1 to FIG. 6. FIG. 1 illustrates a schematic structure of a flash smelting furnace 100 for copper smelting in accordance with the embodiment.

As illustrated in FIG. 1, the flash smelting furnace 100 has a raw material supply apparatus 1 and a furnace body 2. The raw material supply apparatus 1 is also called a concentrate burner, and supplies concentrate (copper concentrate ($CuFeS_2$ or the like)) acting as raw material, main blast gas for reaction, auxiliary gas for reaction and gas for diffusion (contributing a reaction, too) to the furnace body 2. The furnace body 2 has a reaction shaft 3 in which concentrate and reaction gas are mixed, a settler 4 and an uptake 5. The main blast gas for reaction and the auxiliary gas for reaction are oxygen-enriched gas. The gas for diffusion is air or oxygen-enriched gas. The reaction gas and the diffusion gas diffuse the concentrate, oxidizes the concentrate, and divides the concentrate into matte and slag in a bottom portion of the reaction shaft 3.

Figure 2:
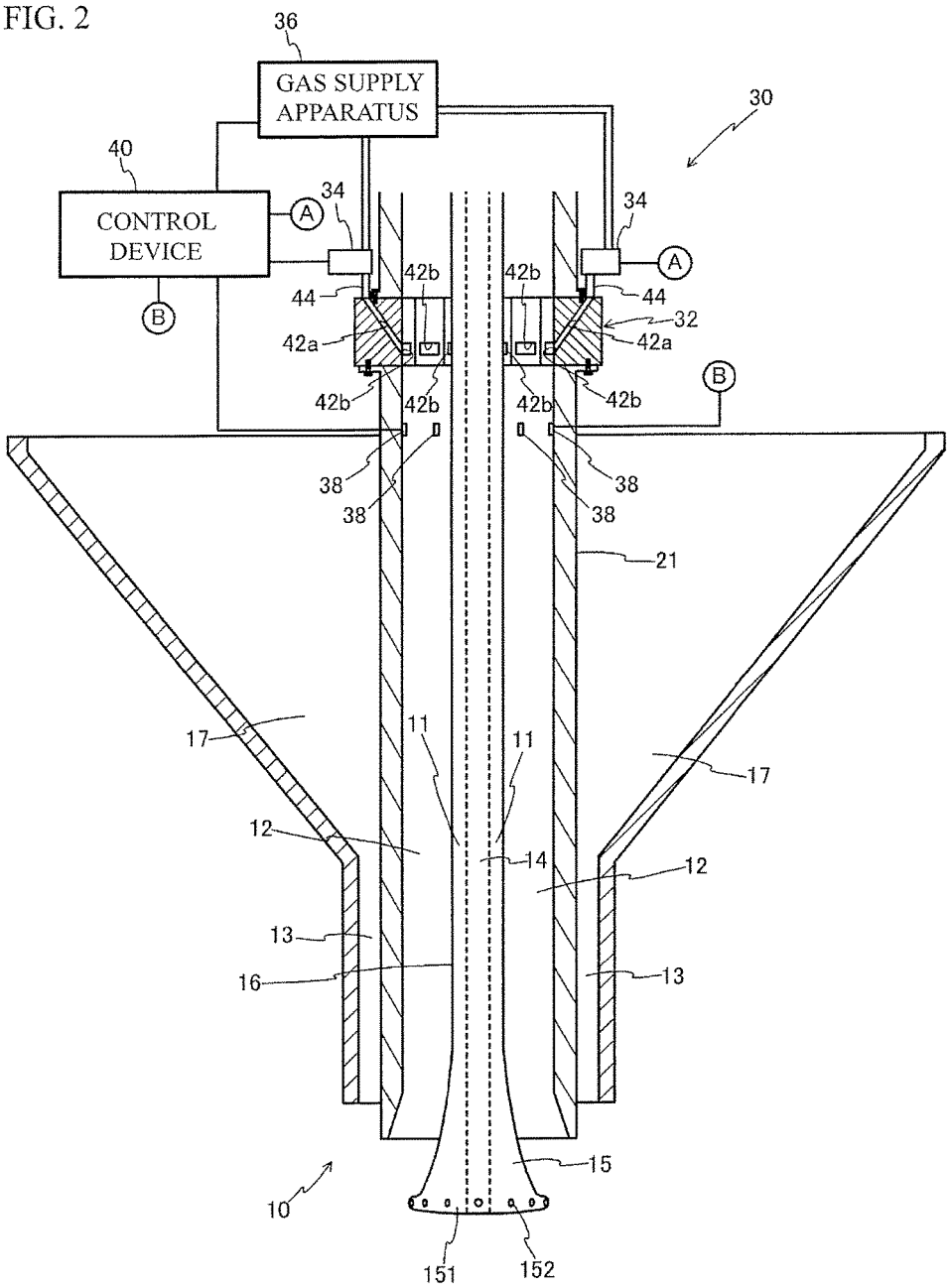
FIG. 2 illustrates a partially enlarged view of a raw material supply apparatus.

FIG. 2 illustrates a partially enlarged view of the raw material supply apparatus 1 and is an explanation drawing of a supply portion 10 that supplies the raw material, the reaction gas and the diffusion gas toward the reaction shaft 3.

The supply portion 10 of the raw material supply apparatus 1 has a lance 16. The lance 16 has a first passage 11 in which the diffusion gas acting as first gas passes and a fourth passage 14 in which the auxiliary gas for reaction passes. The supply portion 10 has a second passage 12 acting as a raw material passage provided on an outer circumference of the lance 16 and a third passage 13 acting as a passage of the reaction gas provided on an outer circumference of the second passage 12. The second passage 12 and the third passage 13 are separated from each other by a separation wall 21 having a cylinder shape.

The first passage 11 supplies the diffusion gas into the reaction shaft 3. The second passage 12 supplies the concentrate into the reaction shaft 3. The third passage 13 supplies the main blast gas for reaction into the reaction shaft 3 from an air chamber 17. The fourth passage 14 supplied the auxiliary gas for reaction into the reaction shaft 3.

A diffusion cone 15 having a hollow circular truncated cone shape is formed on an edge portion (a lower edge) of the lance 16. A plurality of supplying holes 152 to eject the diffusion gas passing through the first passage 11 into the reaction shaft 3 are formed in a lower portion 151 of a side face of the diffusion cone 15.

A structure 30 to equalize raw material acting as an adjuster is provided on the upper side with respect to the air chamber 17 of the separation wall 21. The structure 30 to equalize raw material is a structure for equalizing distribution of the concentrate passing through the second passage 12, and has a rectifying nozzle 32, a plurality of valves 34 to adjust gas flow amount, a gas supply apparatus 36, a non-contact measuring device 38 (a powder flow meter or a particle size distribution meter using a micro wave or a laser), and a control device 40 acting as a controller.

Figure 3A:
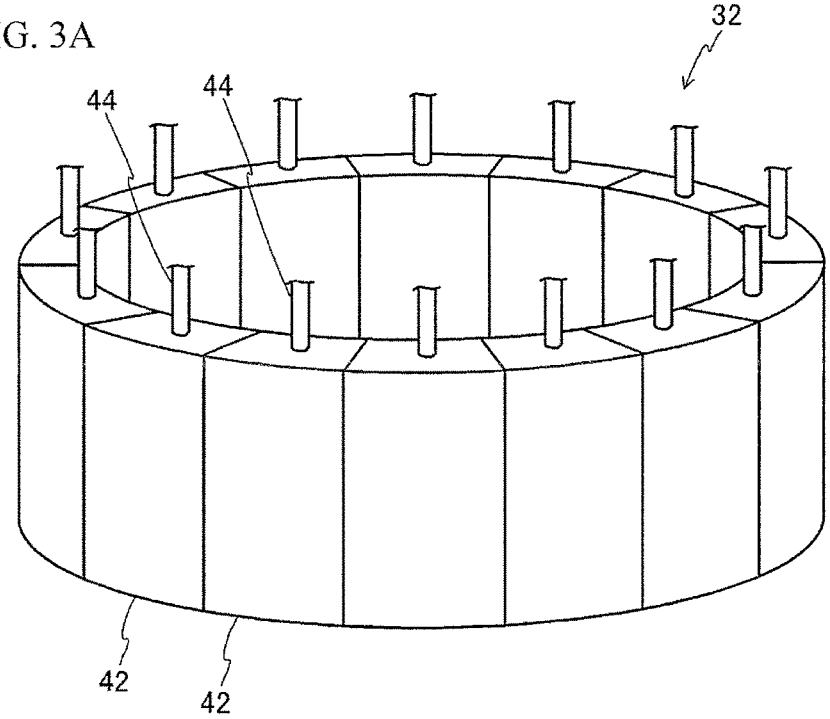
FIG. 3A illustrates a perspective view of a rectifying nozzle.
Figure 3B:
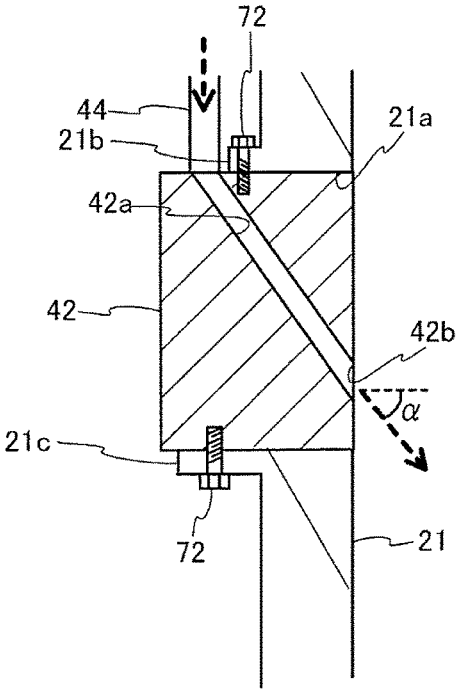
FIG. 3B illustrates a cross sectional view of a divided block and a separation wall.

The rectifying nozzle 32 has a circular ring shape as a whole as illustrated in FIG. 3A. The rectifying nozzle 32 has a plurality of divided blocks 42 acting as a pipe line member. A pipe line 42*a* is formed inside of each divided block 42 as illustrated in FIG. 3B illustrating a cross section of the divided block 42. A gas pipe 44 is connected to the pipe line 42*a*. The divided block 42 can be engaged with a cut portion (slit) 21*a* formed in the separation wall 21 as illustrated in FIG. 3B. The divided block 42 is fixed to a flanges 21*b* and 21*c* formed on an outer circumference of the separation wall 21 by a screw (or a bolt) 72. That is, the divided block is exchangeable with respect to the cut portion 21*a* of the separation wall 21.

The valve 34 to adjust gas flow amount is a valve for adjusting an amount of gas for equalizing raw material that acts as second gas supplied to the gas pipe 44 from the gas supply apparatus 36 and is controlled by the control device 40.

The gas supply apparatus 36 is an apparatus to supply gas for equalizing raw material such as oxygen enriched gas into the second passage 12. The gas for equalizing raw material may be a part of the reaction gas. The gas for equalizing raw material may be compressed gas, compressed nitrogen, or the like. The gas for equalizing raw material supplied from the gas supply apparatus 36 passes through the gas pipe 44 and is blown from the lower edge portion (blowing opening 42*b*) of the pipe line 42*a*. A blowing angle a of the gas for equalizing raw material illustrated in FIG. 3B is within 0 degree to 80 degrees. When the divided block 42 is exchanged, the blowing angle a can be changed. The blowing angle of each divided block can be individually set (to a different angle).

As illustrated in FIG. 3B, the embodiment uses a structure in which the blowing opening 42*b* (a lower edge portion of the pipe line 42*a*) does not project to an inner space surrounded by the separation wall 21. Thus, it is suppressed that the concentrate contacts the blowing opening 42*b* and the blowing opening 42*b* is damaged. It is also suppressed that the blowing opening 42*b* prevents the flow of the concentrate.

The number of the non-contact measuring device 38 (a powder flow meter or a particle size distribution meter using a micro wave or a laser) is two or more. The non-contact measuring devices 38 are arranged at an interval along an inner face of the separation wall 21. The non-contact measuring device 38 sequentially measures a flow amount and distribution of the concentrate passing through the second passage 12.

The control device 40 adjusts an opening degree of the valve 34 to adjust gas flow amount based on the measurement result of the non-contact measuring device 38, and adjusts an amount of gas for equalizing raw material blown from each pipe line 42*a* so that the distribution of the concentrate in the second passage 12 is equalized.

Figure 4A:
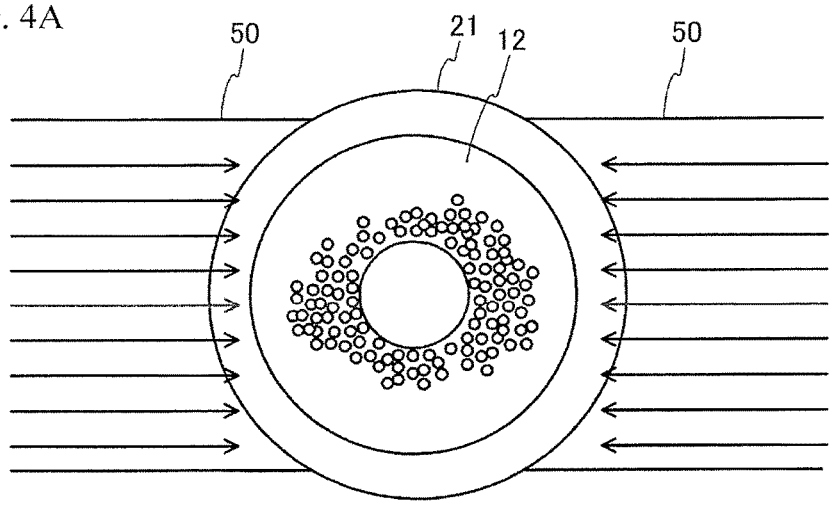
FIG. 4A illustrates a case where concentrate is uneven in a second passage.
Figure 4B:
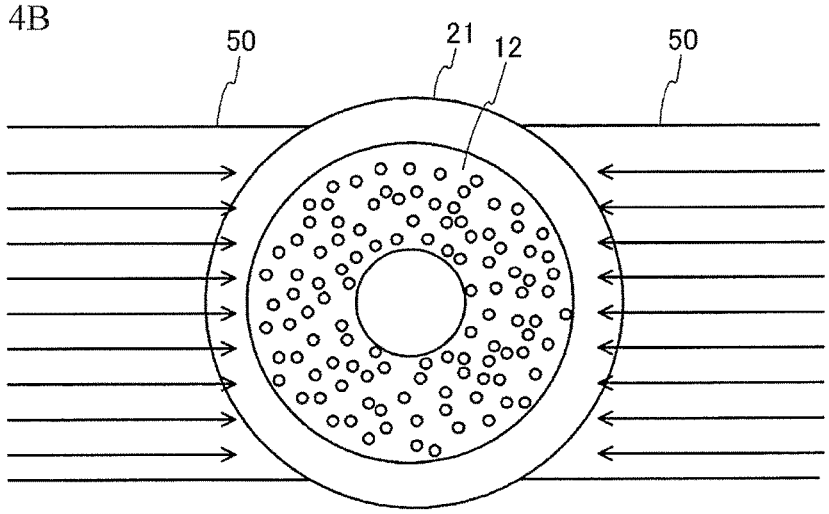
FIG. 4B illustrates a case where the concentrate is even in a second passage.

In the embodiment, as illustrated in FIG. 4A, the concentrate is supplied into the second passage 12 from the supply portion (supply shoot) 50 from two directions. In this case, when the structure 30 to equalize raw material is not used, variability may occur in the distribution of the concentrate as illustrated in FIG. 4A. On the other hand, when the structure 30 to equalize raw material blows gas for equalizing raw material to the concentrate and corrects the flow of the concentrate, the distribution of the concentrate can be equalized as illustrated in FIG. 4B. When the gas for equalizing raw material is blown to the concentrate, particles of the concentrate can be distributed (without blocks) with an aeration function. Thereby, the distribution of the concentrate can be equalized more. In the embodiment, the rectifying nozzle 32 has a plurality of divided blocks. It is therefore possible to finely adjust the blowing amount of the gas for equalizing raw material. Thus, even if the distribution of the concentrate changes from hour to hour (a supply amount of the concentrate is changed), it is possible to equalize the distribution of the concentrate in the second passage 12.

Figure 5:
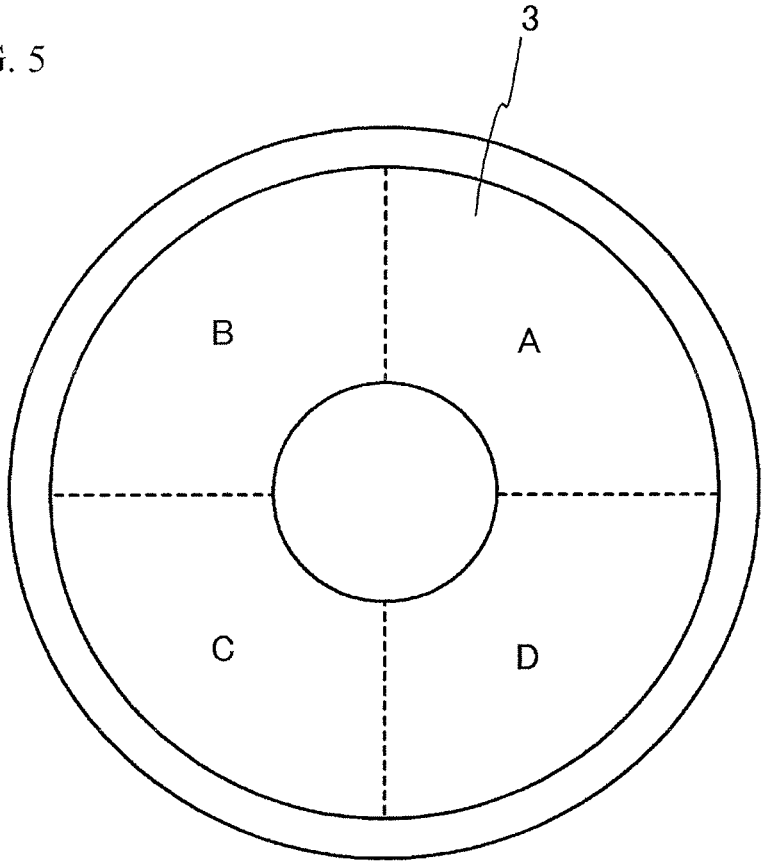
FIG. 5 illustrates a case where a reaction shaft is virtually divided.

FIG. 5 illustrates a case in which the reaction shaft 3 of the furnace body 2 is virtually divided into four parts (regions A to D). When exhausting thermal amount of coolant water (sensible heat of coolant water) of a water jacket cooling each region is measured, a reaction degree of the concentrate in each region can be confirmed.

Figure 6A:
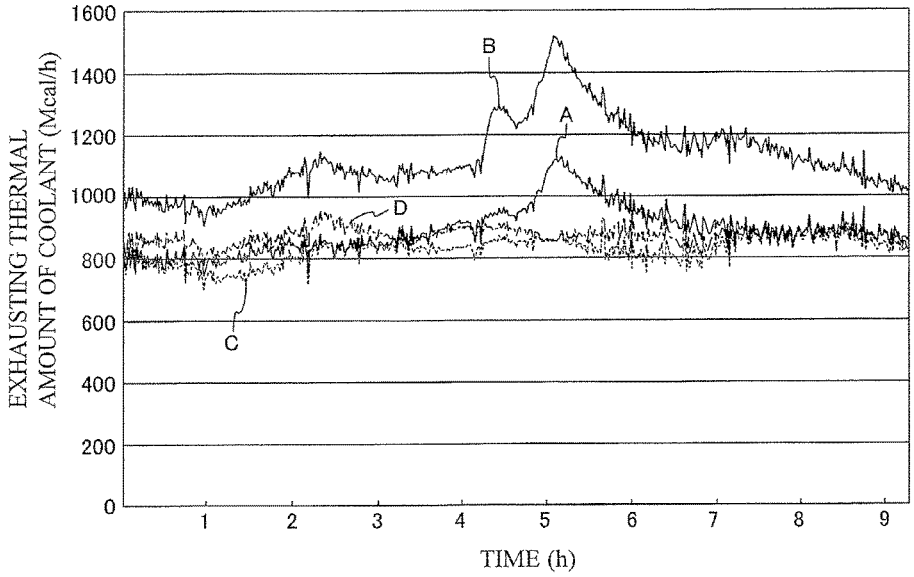
FIG. 6A illustrates an example of transition of an exhausting thermal amount (Mcal/h) of coolant water in a case where concentrate is unevenly supplied.
Figure 6B:
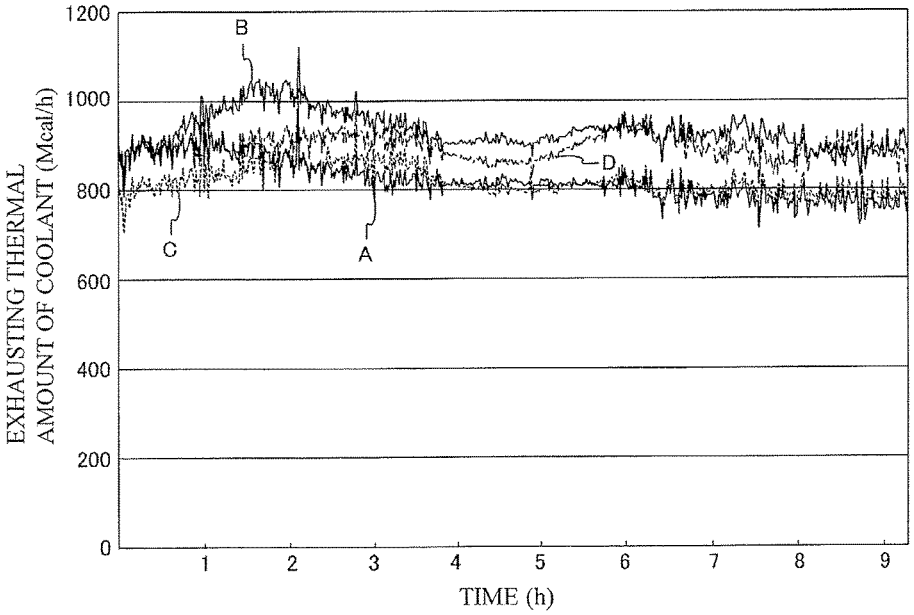
FIG. 6B illustrates an example of transition of an exhausting thermal amount (Mcal/h) in a case where concentrate is evenly supplied.

FIG. 6A illustrates an example of transition of the exhausting thermal amount (Mcal/h) of the coolant water in the case where the concentrate is unevenly supplied as illustrated in FIG. 4A. In the case of FIG. 6A, the exhausting thermal amount of the coolant water is not even in each region. For example, a changing of the region A is large. On the other hand, FIG. 6B illustrates an example of transition of the exhausting thermal amount of the coolant water in the case where the concentrate is evenly supplied as illustrated in FIG. 4B. In the case of FIG. 6B, the exhausting thermal amount of the coolant water is substantially even in each region. And, each changing is small. Therefore, the reaction degree of the concentrate in each region is even and stable. That is, in the embodiment, when the structure 30 to equalize raw material is used, the reaction degree of the concentrate in each region of the reaction shaft 3 can be equalized. And, it is possible to react the concentrate stably.

As mentioned above in detail, in the embodiment, the raw material supply apparatus 1 has the second passage 12, through which the concentrate (raw material) passes, that is provided out of the lance 16 through which the reaction gas passes, and the structure 30 to equalize raw material that blows the gas for equalizing raw material to the concentrate passing through the second passage 12 and adjusts the distribution of the concentrate. It is therefore possible to equalize the distribution of the concentrate passing through the second passage 12. The particles of the concentrate can be distributed by the aeration function of the gas for equalizing raw material. And, the density of the particles is low (without blocks). In view of these points, the distribution of the concentrate can be equalized. Further, in the embodiment, a separation wall or a collision plate is not provided in the second passage 12 acting as the raw material passage. Therefore, the prevention of the raw material flow can be suppressed. In view of this point, the raw material can be equalized.

In the embodiment, the structure 30 to equalize raw material has a plurality of the pipe lines 42*a* that blow the gas for equalizing raw material to the concentrate. And, the control device 40 controls each amount of the gas for equalizing raw material blown to the concentrate from each of the pipe lines based on the measurement result of the non-contact measuring device 38 to measure the distribution of the concentrate. Thus, the amount of the gas for equalizing raw material can be adequately adjusted so that the concentrate is equalized based on actual distribution of the concentrate. Therefore, the concentrate can be equalized with high accuracy. In this case, the divided blocks 42 are used. And, each amount of the gas blown from the pipe lines 42*a* is individually and finely adjusted. Therefore, the distribution of the concentrate can be equalized with high accuracy.

In the embodiment, the divided blocks 42 having the pipe line 42*a* is exchangeable with respect to the cut portion 21*a* provided in the separation wall 21. It is therefore possible to easily adjust the blowing angle a of the gas for equalizing raw material by exchanging the divided block 42.

In the embodiment, the supply portion 50 supplies the concentrate (raw material) to the second passage 12 from two directions. Therefore, for example, ease of maintenance is improved and freedom degree of device designing is improved, compared to the case where the concentrate is supplied from three direction or four directions. Even if the raw material is supplied from two directions, the structure 30 to equalize raw material is provided in the embodiment. Therefore, the distribution of the concentrate can be equalized. However, the number of the direction is not limited to two. The supply portion 50 may supply the concentrate to the second passage 12 from three or more directions.

In the embodiment, the flash smelting furnace 100 has the raw material supply apparatus 1 that is capable of supplying the concentrate evenly. Therefore, the reaction between the concentrate and the oxygen (solid-gas reaction) is performed evenly and speedily. And, variability in the reaction product can be suppressed. Thus, degradation of metal loss to the slag caused by partial generation of peroxide slag can be suppressed.

Figure 7:
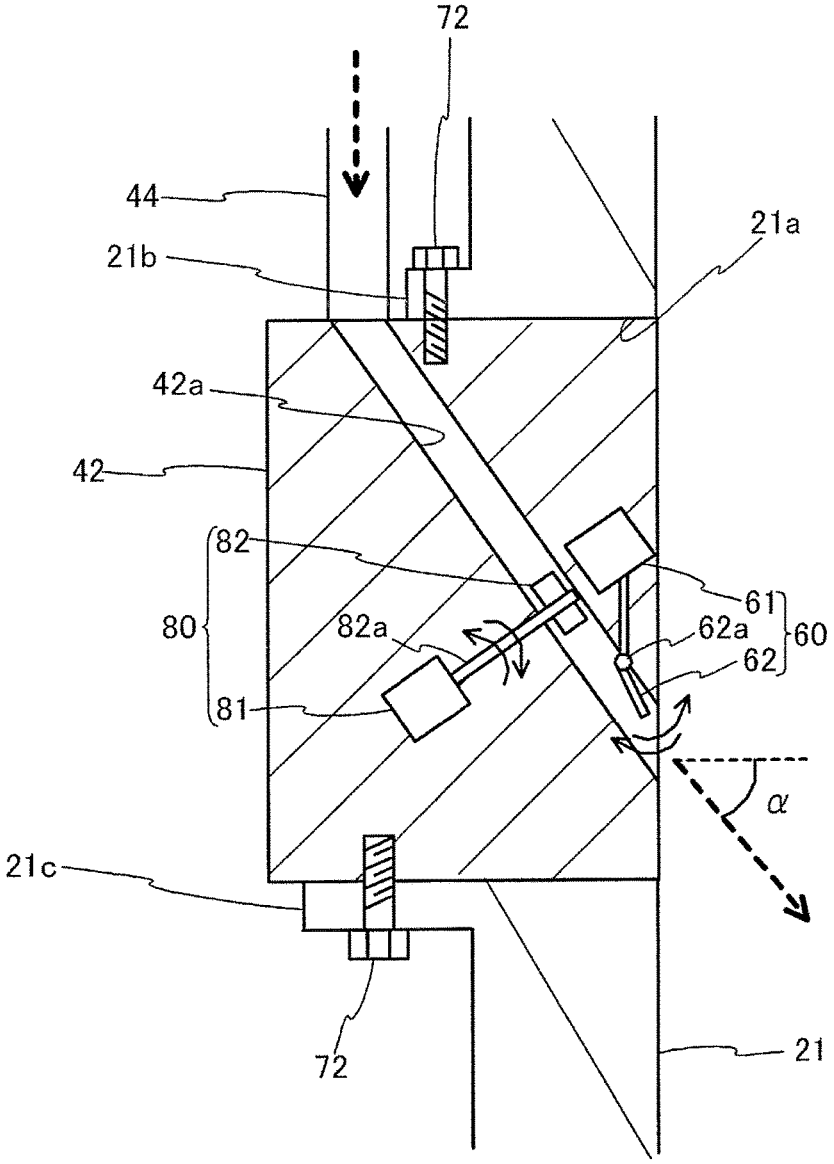
FIG. 7 illustrates a modified embodiment.

In the embodiment, as illustrated in FIG. 7, movable dampers 60 and 80 may be provided in the pipe line 42*a*. The movable damper 60 has a feather member 62 and a drive device 61 that is capable of changing an angle of the feather member 62 by using an axis 62*a* as a reference. When the movable damper 60 is used, it is possible to change the blowing angle a by changing the angle of the feather member 62. The movable damper 80 also has a feather member 82 and a drive device 81 that is capable of changing an angle of the feather member 82 by using an axis 82*a* as a reference. When the movable damper 80 is used, it is possible to change the blowing angle of the gas in front of the paper of FIG. 7 and the gas behind the paper of FIG. 7 by changing the angle of the feather member 82. The control device 40 controls the drive devices 61 and 81.

The control device 40 equalizes the distribution of the concentrate in the second passage 12 by adjusting the opening degree of the valve 34 to adjust gas flow amount and the angles of the feather members 62 and 82 of the movable dampers 60 and 80 based on the measurement result of the non-contact measuring device 38, in the structure of FIG. 7.

One of the movable dampers 60 and 80 may be omitted. Alternately, the number of the movable dampers 60 and 80 may be increased.

In the embodiment, the non-contact measuring device 38 may be provided near each pipe line 42*a*, according to each pipe line 42*a*. Thus, the adequate gas amount blown from each pipe line 42*a* can be controlled with high accuracy.

In the embodiment, the description is given of the case where the control device 40 controls the valve 34 to adjust gas flow amount based on the measurement result of the non-contact measuring device 38. However, the structure is not limited. For example, the control device 40 may monitor the exhausting thermal amount of the coolant water of the water jacket of the reaction shaft 3 and control the valve 34 to adjust gas flow amount according to each blowing opening formed in the rectifying nozzle so that the transition of FIG. 6B is achieved when the exhausting thermal amount of the coolant water is transited as in the case of FIG. 6A.

Figure 8:
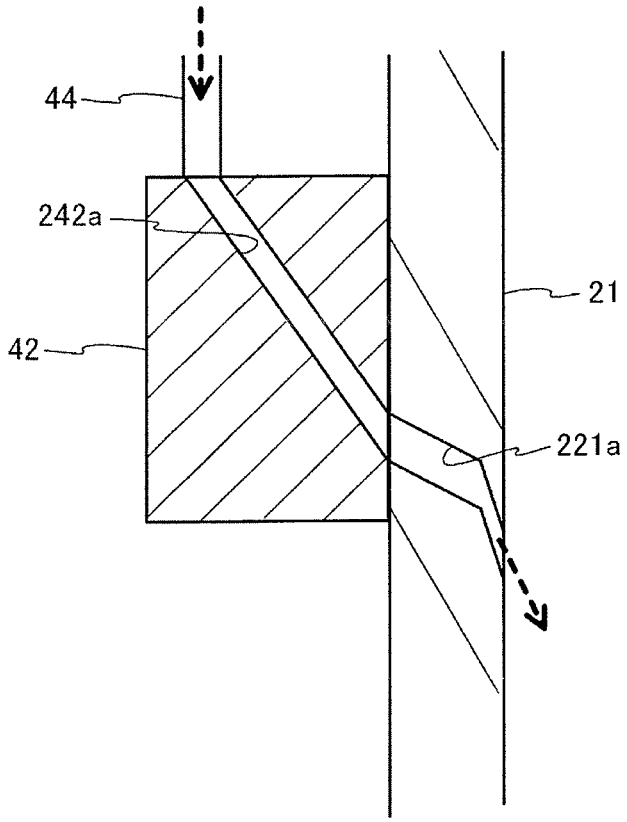
FIG. 8 illustrates a modified embodiment.

In the embodiment, the description is given of the case where the divided blocks 42 of the rectifying nozzle 32 have the structure illustrated in FIG. 3B, is engaged with the cut portion 21*a* (slit) formed in the separation wall 21, and is fixed to the flanges 21*b* and 21*c* by the screw 72. However, the structure is not limited. For example, the divided block 42 may have the structure illustrated in FIG. 8. That is, a pipe line 242*a* may be formed in each of the divided blocks 42 as illustrated in FIG. 8, and the pipe line 242*a* may communicate with a blowing pipe line 221*a* formed in the separation wall 21. The divided block 42 may be fixed to the separation wall 21 by a screw.

At least one of the movable damper 60 and the movable damper 80 of FIG. 7 may be provided in the blowing pipe line 221*a* for blowing of FIG. 8. Thus, the blowing angle of the gas from the blowing pipe line 221*a* for blowing can be adjusted.

In the embodiment, the description is given of the case where the structure 30 to equalize raw material is provided in a raw material supply apparatus (concentrate burner) of a flash smelting furnace. However, the structure is not limited. The structure to equalize raw material may be applied to another reaction furnace.

The present invention is not limited to the specifically disclosed embodiments and variations but may include other embodiments and variations without departing from the scope of the present invention.

What is claimed is:

1. A raw material supply method that supplies a raw material into a flash smelting furnace comprising:

blowing a gas into a raw material passage through which the raw material passes, the raw material passage having a plurality of pipe lines, the gas being blown from the plurality of pipe lines, the plurality of pipe lines being arrayed one by one in a circumferential direction of the raw material passage, arrangement of the plurality of pipe lines forming a circle shape surrounding the raw material passage in a ring that is formed by a plurality of sections, each of the plurality of pipe lines extending through a respective on of the sections of the ring;

measuring a distribution of the raw material blown by the gas, with use of a non-contact measuring device positioned within the raw material passage; and adjusting each amount of the gas blown from the plurality of pipe lines, by adjusting the amount of gas blown from each one of the plurality of pipe lines, so that the distribution of the raw material in the raw material passage is equalized, based on a measurement result obtained in the measuring of the distribution.

2. The method as claimed in claim 1, wherein:

the gas is blown into the raw material passage from a plurality of directions in the blowing of the gas; and at least one of an amount and an angle of the gas blown from the plurality of directions is adjusted in the performing of the adjusting.

* * * * *